US010772376B2

(12) United States Patent
Vrijburg

(10) Patent No.: US 10,772,376 B2
(45) Date of Patent: Sep. 15, 2020

(54) SKI SHOE TONGUE ASSEMBLY

(71) Applicant: Dutch Thinking Management B.V., Rotterdam (NL)

(72) Inventor: Sjoerd Gerard Vrijburg, Rotterdam (NL)

(73) Assignee: Dutch Thinking Management B.V., Rotterdam (NL)

( * ) Notice: Subject to any disclaimer, the term of this patent is extended or adjusted under 35 U.S.C. 154(b) by 0 days.

(21) Appl. No.: 16/088,547

(22) PCT Filed: Mar. 27, 2017

(86) PCT No.: PCT/NL2017/050191
§ 371 (c)(1),
(2) Date: Sep. 26, 2018

(87) PCT Pub. No.: WO2017/171542
PCT Pub. Date: Oct. 5, 2017

(65) Prior Publication Data

US 2019/0133245 A1 May 9, 2019

(30) Foreign Application Priority Data

Mar. 26, 2016 (NL) ..... 2016499

(51) Int. Cl.
*A43B 5/04* (2006.01)
*A43B 23/26* (2006.01)

(52) U.S. Cl.
CPC ..... *A43B 5/0429* (2013.01); *A43B 23/26* (2013.01)

(58) Field of Classification Search
CPC ... A43B 5/0429; A43B 5/0431; A43B 5/0433; A43B 23/26
(Continued)

(56) References Cited

U.S. PATENT DOCUMENTS 5,050,319 A * 9/1991 Perotto ..... A43B 5/0405 36/117.6
6,360,454 B1 * 3/2002 Dachgruber ..... A43B 5/0401 36/117.1
(Continued)

FOREIGN PATENT DOCUMENTS

DE 8133090 U1 3/1982
EP 0370948 A1 5/1990
(Continued)

*Primary Examiner* — Ted Kavanaugh
(74) *Attorney, Agent, or Firm* — The Webb Law Firm

(57) ABSTRACT

The present invention relates to a ski shoe tongue assembly (1) with an outer side for arranging against an inner side of a ski shoe (19) and an inner side for arranging against a leg for the purpose of—providing a filled space between the ski shoe (19) and the leg, comprising: —a buffer body (21, 2, 38) for providing a buffer between an inner side of a ski shoe (19) and a lower leg, having on the front side an outer surface which is curved during use for, lying against the inner side of, the ski shoe (19), —wherein the buffer body (21, 2, 38) is arranged during use in front of the front side of the leg and in top view extends over a part of the front side of the leg, and—the buffer body (21, 2, 38) comprising, a substantially flat tibia contact surface (4) on the inner side substantially, providing congruence with a tibia for the purpose of making contact with a surface of the leg formed by the tibia of the lower leg.

18 Claims, 6 Drawing Sheets

(58) Field of Classification Search
USPC ..... 36/109, 54
See application file for complete search history.

(56) References Cited

U.S. PATENT DOCUMENTS

| | | | | |
|---|---|---|---|---|
| 6,490,730 | B1 * | 12/2002 | Lyden | A41D 13/0153 2/22 |
| 9,578,919 | B2 | 2/2017 | Greene et al. | |
| 10,051,912 | B2 | 8/2018 | Darden et al. | |
| 2006/0179551 | A1 * | 8/2006 | Vrijburg | A63B 71/1225 2/267 |
| 2014/0007462 | A1 * | 1/2014 | Engel-Currin | A41D 13/0543 36/109 |
| 2015/0033585 | A1 * | 2/2015 | Otus | A43B 1/0081 36/109 |

FOREIGN PATENT DOCUMENTS

| | | | |
|---|---|---|---|
| EP | 1319347 | A1 | 6/2003 |
| WO | 2011043998 | A2 | 4/2011 |
| WO | 2014085646 | A1 | 6/2014 |

* cited by examiner

SKI SHOE TONGUE ASSEMBLY

CROSS-REFERENCE TO RELATED APPLICATIONS

This application is the United States national phase of International Application No. PCT/NL2017/050191 filed Mar. 27, 2017, and claims priority to Dutch Patent Application No. 2016499 filed Mar. 26, 2016, the disclosures of which are hereby incorporated in their entirety by reference.

BACKGROUND OF THE INVENTION

Field of the Invention

The present invention relates to a ski shoe tongue assembly with an outer side for arranging against an inner side of a ski shoe and an inner side for arranging against a leg for the purpose of providing a filled space between the ski shoe and the leg.

Description of Related Art

During skiing use is made of a boot-like high shoe, also referred to as ski shoe, for coupling the lower leg to the ski. The lower leg is enclosed here in this ski shoe. An inner shoe is applied in order to protect the leg relative to the hard shell of the ski shoe. The inner shoe has for this purpose a substantially fixed protection for the rear side and both sides of the leg, which inner shoe has a movable tongue for protecting the front side of the leg.

Although the inner shoe, and particularly the tongue thereof, protects the front side of the leg, the present invention provides an improvement which has the object of further improving the transfer of forces between the tongue and the leg while using parts of the leg which are better suitable for this purpose.

SUMMARY OF THE INVENTION

The present invention provides for this purpose a ski shoe tongue assembly with an outer side for arranging against an inner side of a ski shoe and an inner side for arranging against a leg for the purpose of providing a filled space between the ski shoe and the leg, comprising:

a buffer body for providing a buffer between an inner side of a ski shoe and a lower leg, having on the front side an outer surface which is curved during use for lying against the inner side of the ski shoe, wherein the buffer body is arranged during use in front of the front side of the leg and in top view extends over a part of the front side of the leg, and the buffer body comprising a substantially flat tibia contact surface on the inner side substantially providing congruence with a tibia for the purpose of making contact with a surface of the leg formed by the tibia of the lower leg.

The present invention provides the important advantage of an increased contact between the tibia and the tibia contact surface, this where a prior art ski shoe tongue without tibia contact surface makes substantially no contact with the relatively flat part of the tibia, but does make high-intensity contact with the front side edge of the tibia.

The tibia has a relatively narrow edge on the front side of the leg. However, the tibia has a large forward inclining surface, the tibia surface referred to in this document. The present invention uses the tibia surface to distribute forces over the whole surface and to use this tibia surface to exert forces.

A further advantage of the present invention is that, by being taken up pressure over the substantially flat tibia surface and the tibia contact surface, these forces are distributed over a large surface area. A significant advantage hereof is that, when steering into a bend, by pressing with the tibia surface on the tibia contact surface of the buffer body great forces can be exerted on this tibia contact surface particularly because of the large contact surface area realized between the tibia surface and the tibia contact surface.

This provides a high measure of sense of control. A great sense of comfort is also provided, precisely during exertion of these steering forces. For clarification, the steering forces are exerted by the right tibia in a bend to the left and by the left tibia in a bend to the right.

A further significant advantage according to the invention is that, because the forces are taken up by the large tibia surface instead of by the narrow tibia edge, the pressure between the muscle contact surface and the respective muscle surface of the leg can be reduced. These muscles can hereby function at a reduced pressure relative to a prior art tongue, this significantly enhancing the sense of comfort and the effectiveness of the muscle. The muscles (anterior muscles) at the muscle contact surface also hereby tire much less quickly during the hours of skiing.

Pressure differences between the different contact surfaces between the ski shoe tongue assembly and the leg are also of great importance in this invention. The description assumes contact surfaces between the buffer body and the leg even when there are areas where in some situations there is not always direct pressure contact, such as when the contact can be broken during use or when there are areas where there is no direct contact because of the shape of for instance an individual leg. According to respective exemplary embodiments the pressure on the muscle contact surface can, as stated, for instance be reduced while the pressure on the tibia surface is increased.

The term contact surface is applied for the clarity of description it provides. When it is used in the ski shoe there will always be contact between the leg and the buffer body of the invention. The object of the invention is precisely that forces are applied to parts of the leg which are better suited to this end in a manner optimal for the purpose in contrast to the prior art.

According to a first preferred embodiment, the tibia contact surface is arranged relative to the outer surface which is curved during use such that during use it makes congruent contact with the tibia of the lower leg. This congruent contact provides an optimal distribution of forces over this surface. The pressure is hereby also distributed optimally. In addition, the pressure on the muscle surface of the leg can hereby be reduced. The tibia contact surface is more preferably substantially flat.

According to a further preferred embodiment, the muscle contact surface has substantially the same shape as the outer surface, and wherein the buffer body is provided with the tibia contact surface extending along the entire length of the tibia contact surface as a substantially straight surface at an angle $\alpha$ from the muscle contact surface, preferably thereby following the surface of the tibia during use. The distribution of forces in accordance with the above stated objectives is hereby further improved in practical manner.

The buffer body is more preferably manufactured from a deformable material such as a foam material. In the context of the present invention already known in itself foam materials for footwear or clothing or for providing buffer members for the human body can also be applied.

According to a further preferred embodiment, the buffer body is manufactured from a first material and, at the position of the tibia contact surface, the buffer body is manufactured from a second material. Because the tibia surface can absorb relatively high forces when a tibia contact surface according to the present invention is applied, provision is made that a material can be used for this tibia contact surface which can apply higher forces to the tibia surface of the leg relative to the forces applied to the muscular surface of the leg. A foam material is therefore possible here which is stiffer or harder than for the rest of the buffer body. During for instance inward steering and when applying steering forces to the tibia contact surface of the buffer body with the tibia surface of the leg a perceptible feedback is provided here which realizes a greater measure of control by the skier. In other words, it provides a better feel.

Provided for the purpose of modifying the ski shoe tongue assembly to individual preferences of a skier is a tibia contact surface element forming the tibia contact surface and being removably placeable in the buffer body. The skier can hereby make a choice in respect of the hardness of the material. The tibia contact surface element is therefore more preferably manufactured here from a material other than that of the rest of the buffer body. It is envisaged here that the buffer body is manufactured at the position of the tibia contact surface from a harder or firmer material than at the position of the muscle contact surface.

According to a further preferred embodiment, the buffer body has a thickness decreasing as seen from the top downward. A gradual increase of the buffering is hereby realized, with a greatest buffering at the position of an upper edge of the ski shoe shaft. Hereby also realized is that on the underside of the ski shoe shaft, where there is less space, less material is present.

The ski shoe tongue assembly is preferably attached to an inner shoe of a ski shoe. Although the ski shoe tongue assembly can be manufactured separately, it is preferred that it be assembled together with the inner shoe for logistical reasons in the channel after production. A tibia contact surface element which can be supplied separately is for instance logistically much easier to handle and can for instance be sent on later to an individual skier. The normal postal service can even be used here.

According to a further preferred embodiment the ski shoe tongue assembly is provided, for the purpose of allowing exchangeability thereof, with coupling means for releasable coupling to an inner shoe of a ski shoe, preferably with corresponding coupling means provided on the inner shoe of the ski shoe. An advantage hereof is for instance that, relative to the rest of the inner shoe, the ski shoe tongue assembly can be adapted in more precise manner to individual dimensioning and requirements as identified within the scope of the present invention.

For the purpose of a further strengthening thereof the ski shoe tongue assembly is preferably provided with a cover element, such as preferably a flexible rigid sheet material in a form adapted to the shape of the leg opening of the shoe.

According to a further preferred embodiment, the rigid sheet material comprises a tibia follower part for following a part of the tibia substantially parallel to the surface of the leg formed by the tibia of the leg, more preferably comprising a filler element for filling a space between the tibia follower part and the ski shoe during use, more preferably wherein the buffer body has a uniform thickness. It hereby becomes possible that the pressure which the tibia exerts on the tibia follower part is to some extent perceived directly because the thickness of the buffer body, in other words the thickness of the foam material that is present, is relatively small, whereby compression thereof takes place to limited extent. The more direct extent of steering of the ski in bends through pressing by means of the tibia is hereby increased.

According to a further preferred embodiment, the buffer body extends during use from a left-hand side of the leg to a right-hand side of the leg. A buffer body is hereby provided at the location of both the tibia and the muscular mass on the outer side of the leg. The buffer body more preferably comprises a substantially curved muscle contact surface on the inner side substantially providing congruence with a muscular part of the lower leg. The muscular mass is subjected to less load through application hereof, particularly in relation to the load exerted on the inclining but flat part of the tibia.

According to a further preferred embodiment, the connection between the buffer body and a cover element and/or a hard part of the tongue is releasable, such as by means of a hook and loop connection. It hereby becomes possible to apply different dimensions of the buffer body in a ski shoe tongue assembly or ski shoe. It hereby also becomes possible to arrange the tibia contact further inward or outward for the purpose of thereby adjusting or setting the directness of the steering by means of the tibia.

A further aspect according to the present invention relates to a buffer body for use in the ski shoe tongue assembly for the purpose of providing a buffer between an inner side of a ski shoe and a lower leg, having on the front side an outer surface which is curved during use for lying against the inner side of the ski shoe, wherein the buffer body is arranged during use in front of the front side of the leg and in top view extends over a part of the front side of the leg, and the buffer body comprising a substantially flat tibia contact surface on the inner side substantially providing congruence with a tibia for the purpose of making contact with a surface of the leg formed by the tibia of the lower leg. Advantages of this aspect are similar to advantages as described with reference to the above stated aspect.

According to a preferred embodiment, the buffer body is arranged in an elongate sleeve-like element, wherein the sleeve-like element is suitable for arranging round a tongue of a ski shoe, and the sleeve-like element serves for functional arrangement of the buffer body on the inner side of the tongue of the ski shoe, the tibia contact surface being arrangeable on the inner side substantially for providing congruence with a tibia for the purpose of making contact with a surface of the leg formed by the tibia of the lower leg. It hereby becomes possible to place the buffer body over each tongue of a ski shoe not provided with a buffer body for co-action with the tibia by means of a tibia contact surface according to the present invention, while using the sleeve.

BRIEF DESCRIPTION OF THE DRAWINGS

Further advantages, features and details of the present invention will be described in greater detail hereinbelow on the basis of one or more preferred embodiments with reference to the accompanying figures. Similar, though not necessarily identical components of different preferred embodiments are designated with the same reference numerals.

DESCRIPTION OF THE INVENTION

Figure 1:
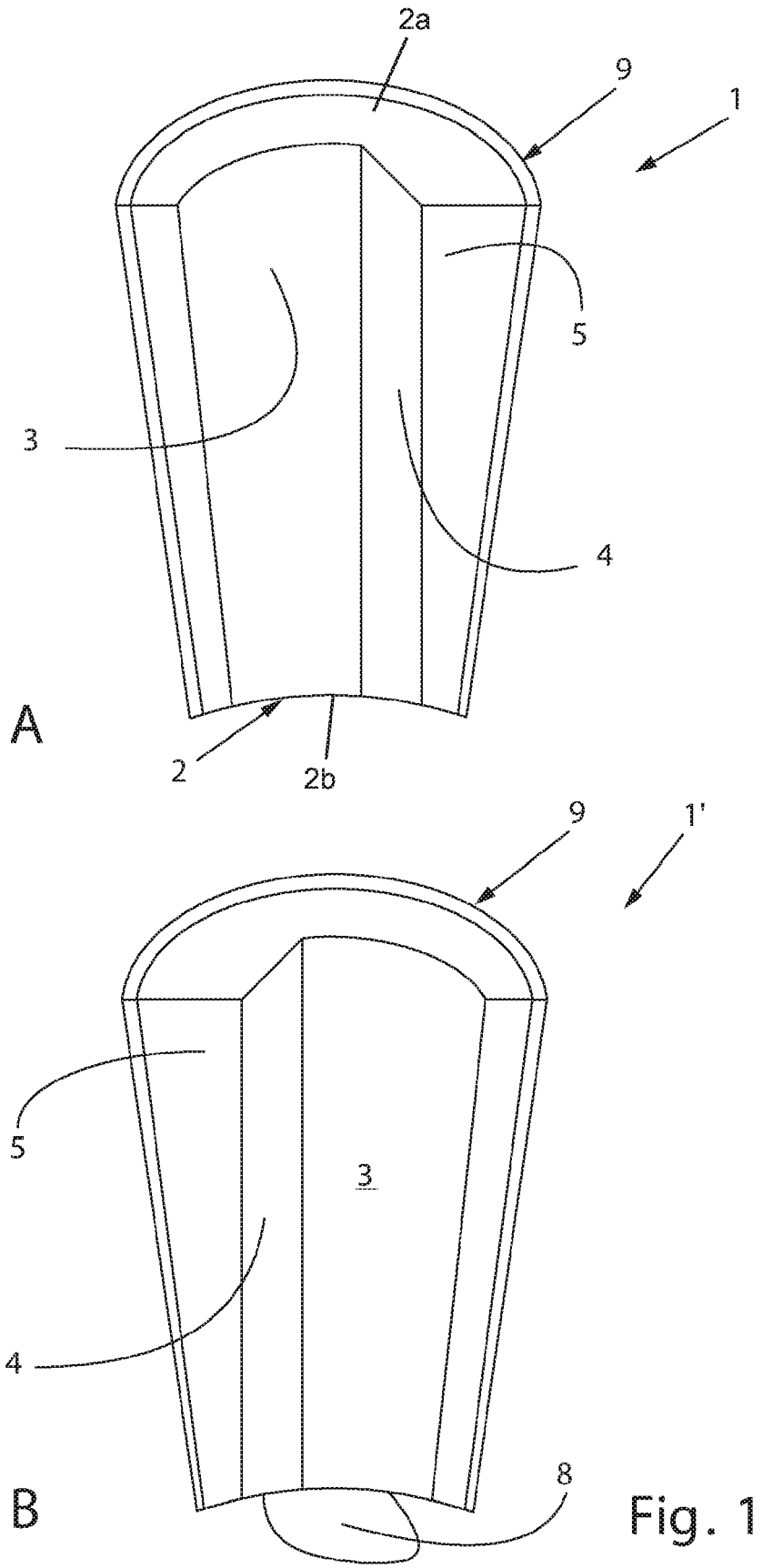
FIG. 1 shows two perspective views of a preferred embodiment according to the present invention for a left leg and a right leg.
Figure 2:
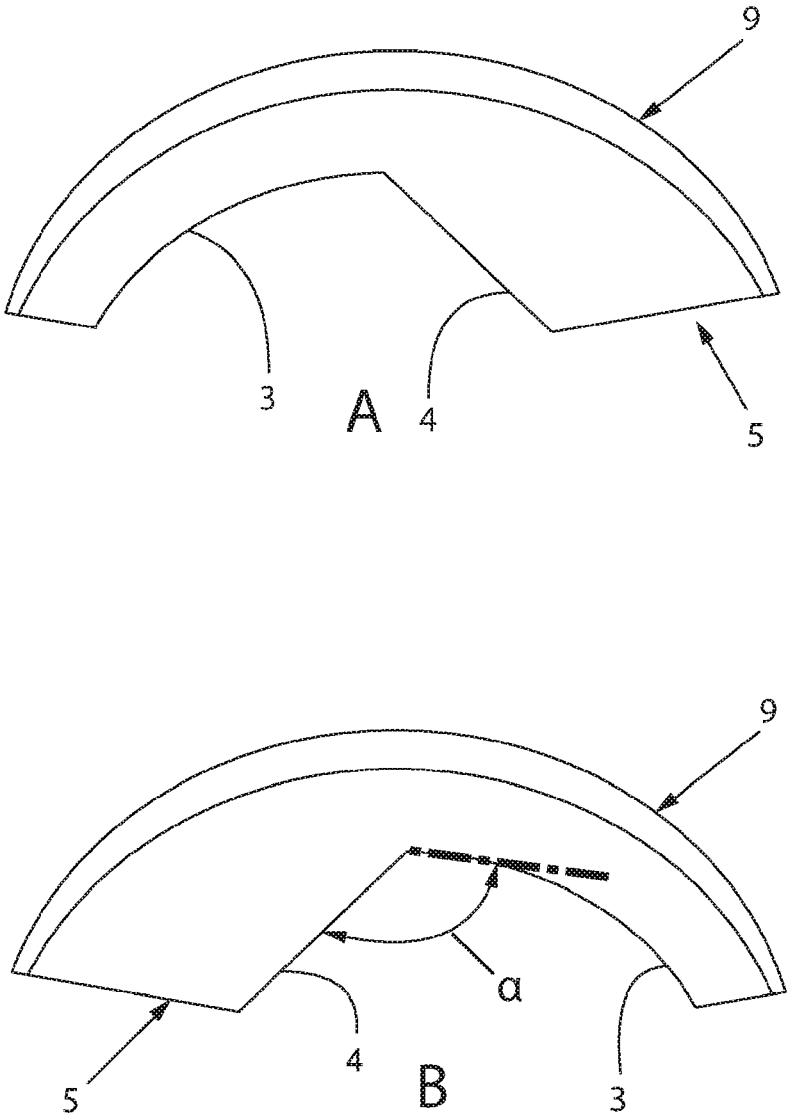
FIG. 2 shows two respective cross-sectional views of a preferred embodiment according to the present invention.

A first preferred embodiment (FIG. 1) according to the present invention relates to a ski shoe tongue assembly 1. This comprises a buffer body 2 forming a muscle contact surface 3 and a tibia contact surface 4 for contact with a lower leg of a human body.

The tibia contact surface is formed by a tibia contact surface element 5 which in this preferred embodiment is formed integrally with buffer body 2.

Also arranged on what is the front side of the ski shoe tongue assembly during use is a sheet element 5 forming a cover element which is arranged against the inner side of the ski shoe during use. When applied, this sheet element 9 also imparts a greater structural integrity to the whole.

The buffer body 2 has a top 2*a* and a bottom 2*b* and, in one embodiment, has a thickness decreasing from the top 2*a* to the bottom 2*b*.

Arranged on the underside are coupling means 8, or tab, on the buffer body 2 for coupling the ski shoe tongue assembly to the inner shoe of a ski shoe, wherein in some cases provision is made for attachment to the outer shoe.

As described at length above, the tibia contact surface provides for a congruent contact between the tibia surface of the leg and the ski shoe tongue assembly. The advantages stated in the foregoing are hereby achieved in practice in practical manner. Using his/her respective tibia surface the skier can transmit forces to the tibia contact surface of the ski shoe tongue assembly. The skier is provided here with a great sense of control. The muscles of the muscle surface of the leg as well as the front edge of the tibia are also relieved of pressure here relative to a prior art ski shoe tongue.

The angle $\alpha$ between a tangential extension of the muscle contact surface and the tibia contact surface at the point of intersection of the tibia contact surface and the muscle contact surface contributes toward optimizing of the pressure on the leg in the context of the present invention. Within the scope of the present invention the skilled person can hereby vary this angle in order to provide a ski shoe tongue assembly which is optimal for the combination of the ski shoe and the leg.

Figure 3:
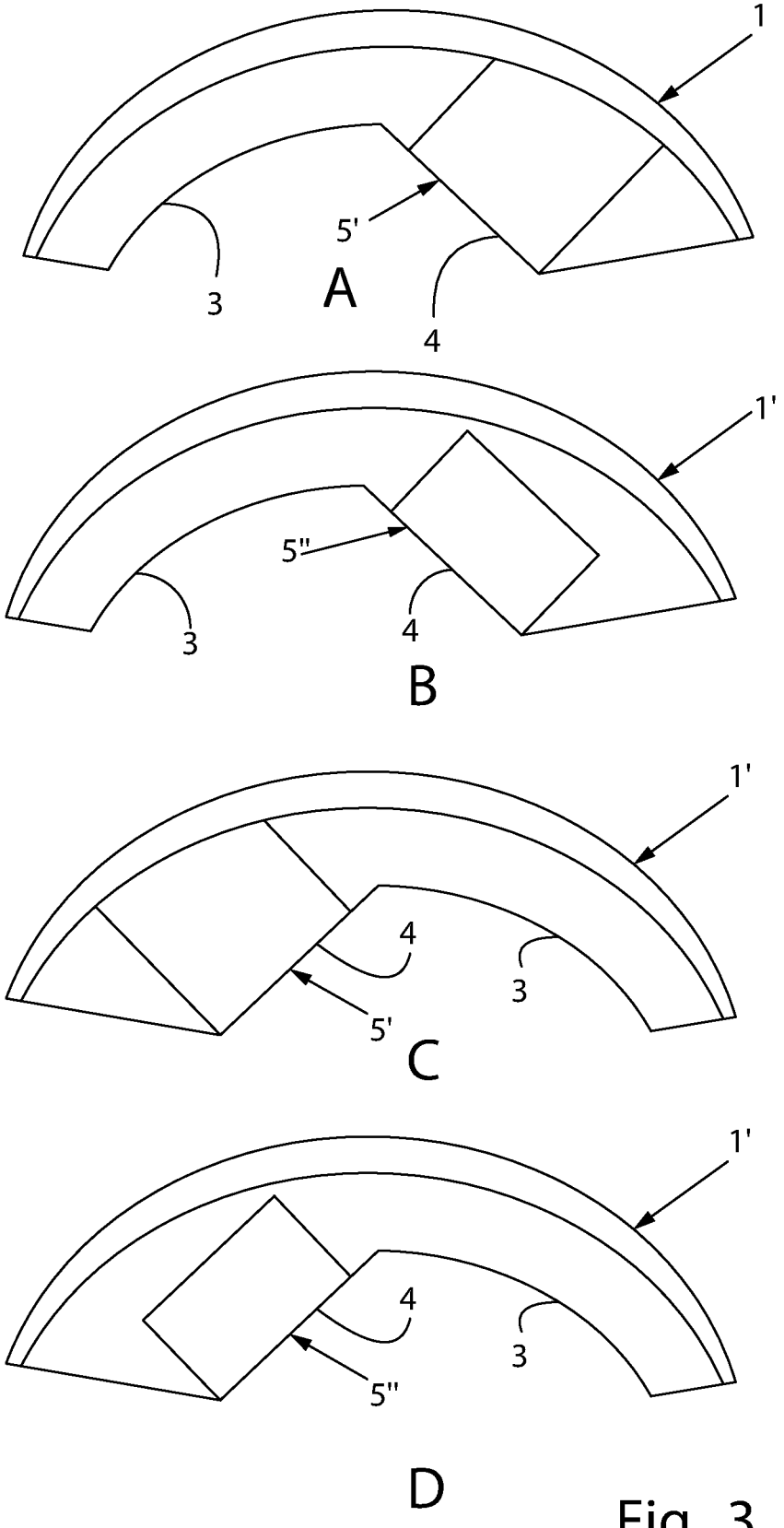
FIG. 3 shows four respective cross-sectional views of further preferred embodiments according to the present invention.
Figure 4:
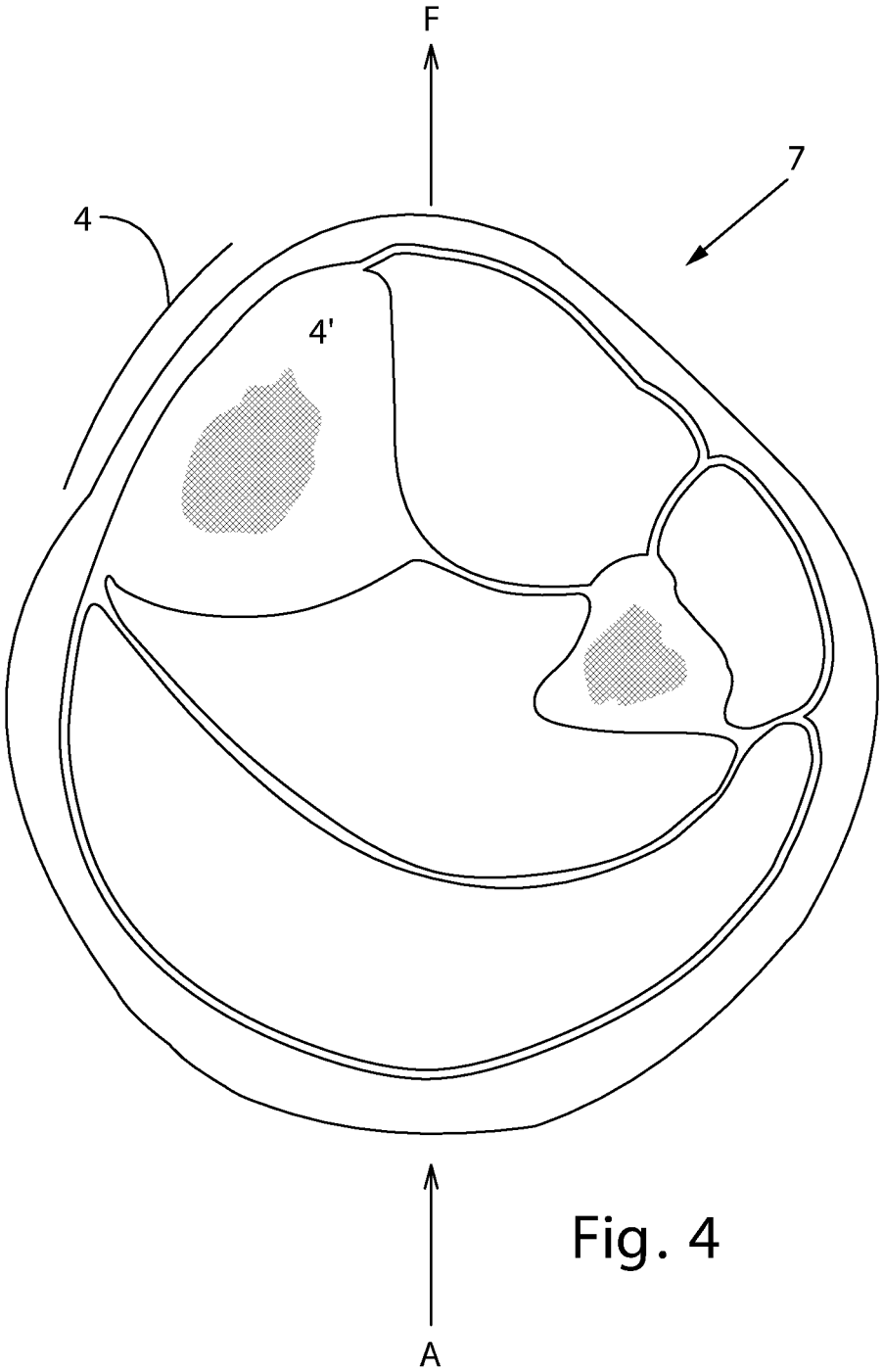
FIG. 4 shows a cross-section of the lower leg with a schematic representation of the placing of a tibia contact surface relative to a tibia surface of the leg.

This angle $\alpha$ can also be adjusted by applying a separate insert 5', 5" as tibia contact surface element (FIG. 3). Such an insert also provides the advantage that the material thereof can be freely selected independently of the material of the buffer body. The sense of control can hereby be adapted to the wishes of the individual skier. The measure of protection the tibia contact surface provides to the tibia surface can also be determined or adjusted herewith.

A harder insert provides for a greater degree of feedback, and thereby a different sense of control, than a softer insert. A softer insert can on the other hand provide a greater measure of protection of the skin at the tibia surface.

Figure 5:
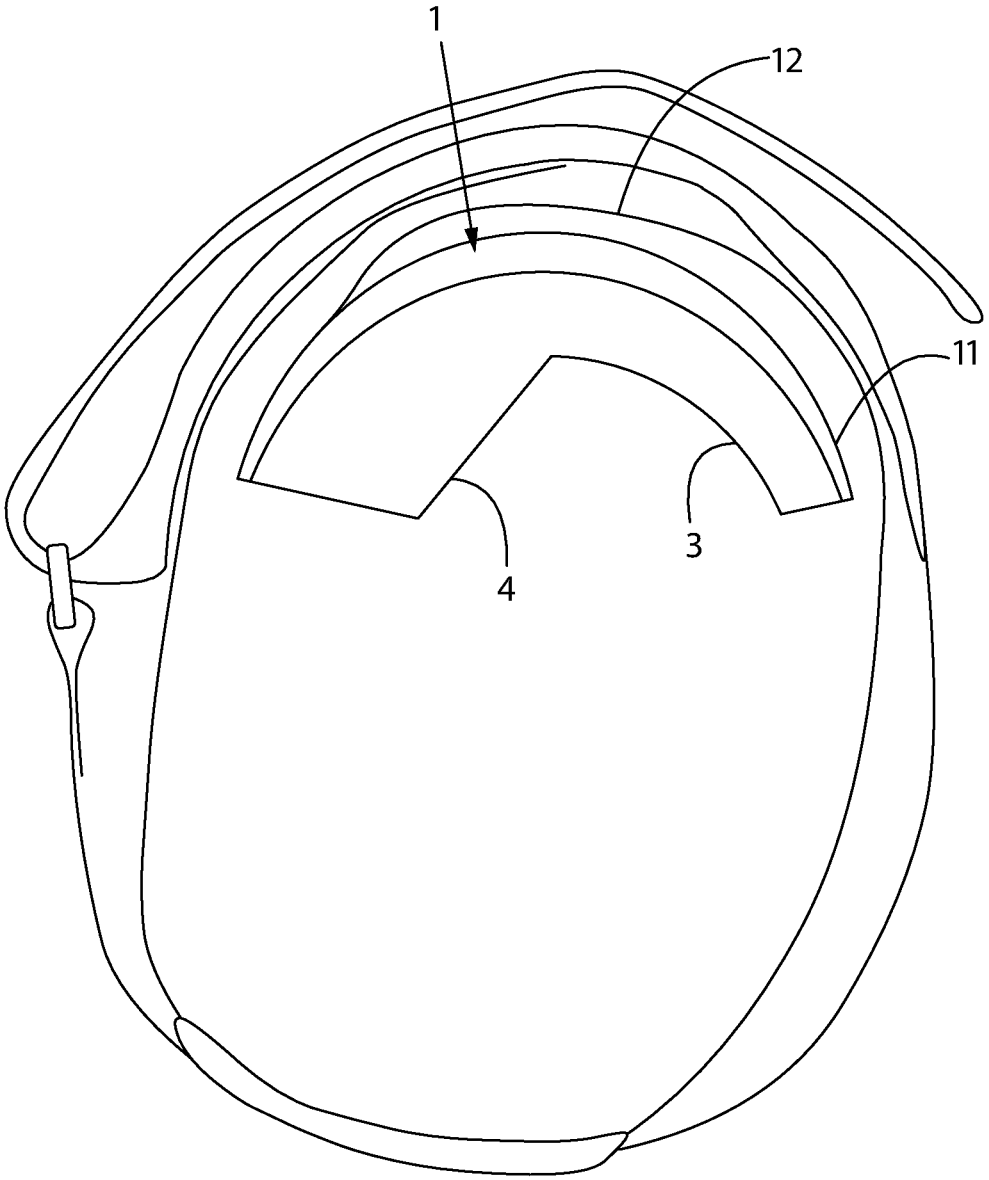
FIG. 5 shows a top view of a ski shoe with a schematic cross-sectional view of an example of a ski shoe tongue assembly arranged therein.

The placing in the ski shoe is shown schematically in FIG. 5. This is a ski shoe for the right foot. The ski shoe has hard flaps 11, 12 for providing firmness, which hard flaps 11, 12 are however very uncomfortable for the leg. A tongue is therefore required on the front side of the leg. The known prior art tongue has a uniform thickness. The ski shoe tongue assembly according to the present invention provides all the above stated advantages when placed as shown in FIG. 5.

Figure 6:
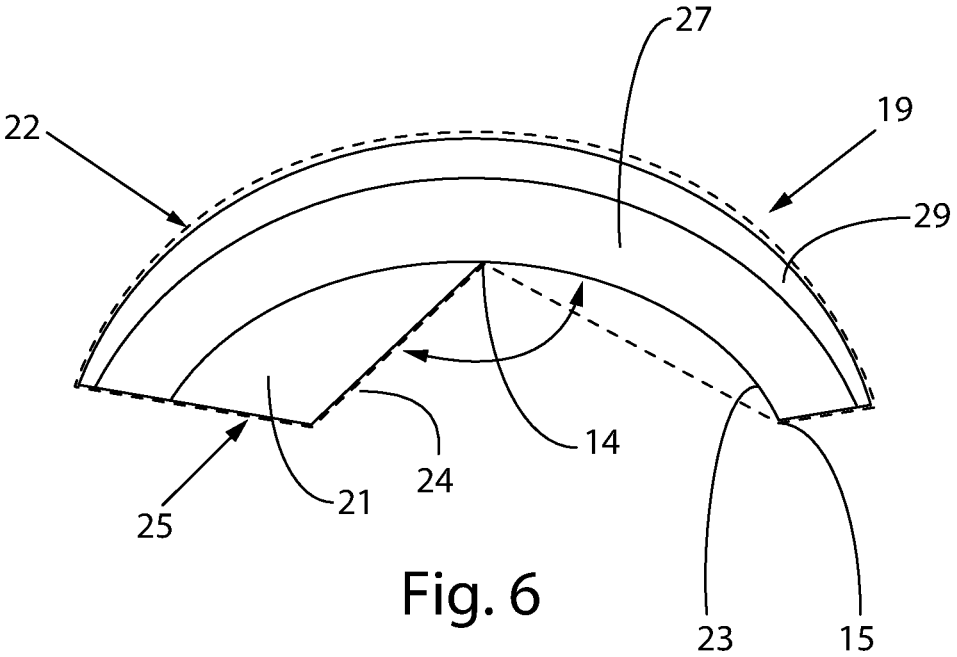
FIG. 6 shows a cross-sectional view of a further preferred embodiment according to the present invention.

FIG. 6 shows a prior art tongue 19 for a ski shoe 19. This has a hard shell 19 and a foam layer 27 according to the prior art. A buffer body 21 is arranged against the inner side of this tongue of the ski shoe with a tibia contact surface 4. A sleeve 22 is arranged round the tongue. Sleeve 22 is attached along surfaces 24, 25 of buffer body 21. The sleeve hereby follows the tongue and the buffer body over substantially the whole periphery except along the path between edge 14 and edge 15 over which the sleeve is freely spanned. This application of a buffer body with a sleeve thus provides a preferred embodiment which is placeable in any prior art ski shoe.

Figure 7:
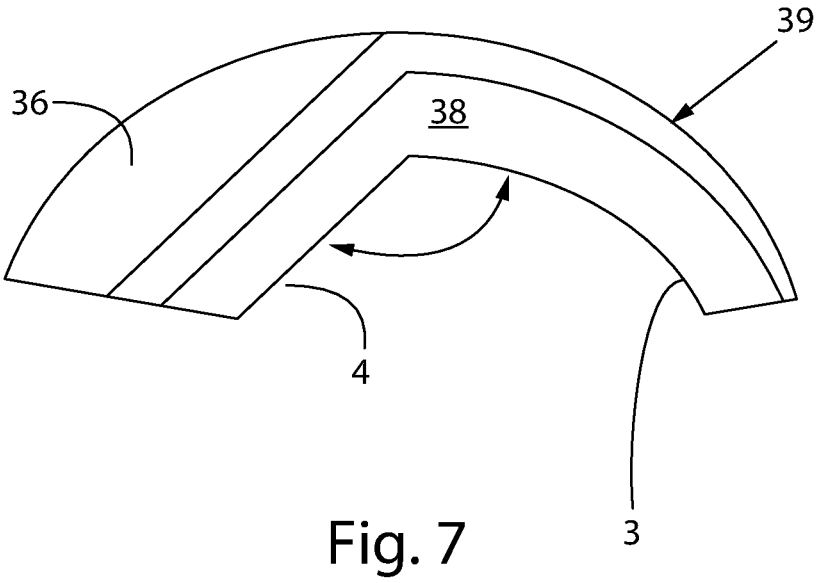
FIG. 7 shows a cross-sectional view of a further preferred embodiment according to the present invention.

Described in FIG. 7 is a further preferred embodiment wherein the flexible rigid sheet body 39 forms a bend for the purpose of following the flat surface of the tibia. In order to impart strength a buffer body 38 of the flexible rigid sheet body 39 is arranged on the side of the leg. For the purpose of support relative to the ski shoe a filler element or filler body 36 is arranged on the outer side of the flexible rigid sheet body 39.

Envisaged in the different preferred embodiments is that a releasable connection is arranged between the buffer body and the flexible rigid sheet body. This is preferably embodied by means of a hook and loop connection. The buffer body is hereby exchangeable relative to the flexible rigid sheet body, such as for the purpose of different sizes of buffer body with different sizes of tibia contact surface.

The present invention has been described in the foregoing on the basis of several preferred embodiments. Different aspects of different embodiments are deemed described in combination with each other, wherein all combinations which can be deemed by a skilled person in the field as falling within the scope of the invention on the basis of reading of this document are included. Leg protecting element for placement in a hard foot wear device that is formed according to one or more elements and providing advantages as disclosed in this document. These preferred embodiments are not limitative for the scope of protection of this document. The rights sought are defined in the appended claims.

The invention claimed is:

1. A ski shoe tongue assembly with an outer side adapted to be arranged against an inner side of a ski shoe and with an inner side adapted to be arranged against a leg for the purpose of providing a filled space between the ski shoe and the leg, comprising:

a buffer body for providing a buffer between an inner side of a ski shoe and a lower leg, having a front side with an outer surface which is curved during use for lying against the inner side of the ski shoe, wherein the buffer body is adapted to be arranged during use in front of a front side of the leg and is adapted to extend over a part of the front side of the leg;

wherein the buffer body comprises a substantially flat tibia contact surface on an inner side opposite to the front side of the buffer body and substantially providing congruence with a tibia for the purpose of making contact with a surface of the leg formed by the tibia of the lower leg and the buffer body further comprises a muscle contact surface adjacent to the tibia contact surface, and wherein the buffer body is formed such that the muscle contact surface of the buffer body has substantially the same shape as the outer surface of the front side of the buffer body, and wherein the buffer body is provided with the tibia contact surface extending along an entire length of the tibia contact surface as a substantially straight surface at an angle $\alpha$ with respect to a tangential extension of the muscle contact surface at the point of intersection of the tibia contact surface and the muscle contact surface.

2. The ski shoe tongue assembly as claimed in claim 1, wherein the tibia contact surface is arranged relative to the outer surface which is curved during use such that during use it makes congruent contact with the tibia of the lower leg.

3. The ski shoe tongue assembly as claimed in claim 1, wherein the buffer body is manufactured from a deformable material.

4. The ski shoe tongue assembly as claimed in claim 1, wherein the buffer body is manufactured from a first material and wherein, at the position of the tibia contact surface, the buffer body is manufactured from a second material.

5. The ski shoe tongue assembly as claimed in claim 1, comprising a tibia contact surface element forming the tibia contact surface and being removably placeable in the buffer body.

6. The ski shoe tongue assembly as claimed in claim 5, wherein the tibia contact surface element is manufactured from a material other than that of the rest of the buffer body.

7. The ski shoe tongue assembly as claimed in claim 1, wherein the buffer body is manufactured at the position of the tibia contact surface from a harder or firmer material than at the position of the muscle contact surface.

8. The ski shoe tongue assembly as claimed in claim 1, wherein the buffer body has a top and a bottom and has a thickness decreasing from the top to the bottom.

9. The ski shoe tongue assembly as claimed in claim 1, wherein the buffer body is adapted to be attached to an inner shoe of a ski shoe.

10. The ski shoe tongue assembly as claimed in claim 1, further comprising a tab provided on the buffer body for releasable coupling to an inner shoe of a ski shoe.

11. The ski shoe tongue assembly as claimed in claim 1, further comprising a cover element in a form adapted to a shape of a leg opening of a shoe.

12. The ski shoe tongue assembly as claimed in claim 11, wherein the cover element is a flexible rigid sheet material that comprises a tibia follower part for following a part of the tibia substantially parallel to the surface of the leg formed by the tibia of the leg.

13. The ski shoe tongue assembly as claimed in claim 1, wherein the buffer body extends during use from a left-hand side of the leg to a right-hand side of the leg.

14. The ski shoe tongue assembly as claimed in claim 1, wherein the buffer body comprises a substantially curved muscle contact surface on the inner side substantially providing congruence with a muscular part of the lower leg.

15. The ski shoe tongue assembly as claimed in claim 1, wherein the connection between the buffer body and a cover element or a hard part of the tongue is releasable.

16. A buffer body for use in a ski shoe tongue assembly for the purpose of providing a buffer between an inner side of a ski shoe and a lower leg, wherein the buffer body has a front surface with an outer surface which is curved during use for lying against the inner side of the ski shoe, wherein the buffer body is adapted to be arranged during use in front of the front side of the leg and is adapted to extend over a part of the front side of the leg, wherein the buffer body comprises a substantially flat tibia contact surface on the inner side substantially providing congruence with a tibia for the purpose of making contact with a surface of the leg formed by the tibia of the lower leg, and wherein the buffer body is formed such that a muscle contact surface of the buffer body adjacent to the tibia contact surface has substantially the same shape as the outer surface of the front side of the buffer body, and wherein the buffer body is provided with the tibia contact surface extending along an entire length of the tibia contact surface as a substantially straight surface at an angle $\alpha$ with respect to a tangential extension of the muscle contact surface at the point of intersection of the tibia contact surface and the muscle contact surface.

17. The buffer body as claimed in claim 16 arranged in an elongate sleeve-like element, wherein the sleeve-like element is adapted to be arranged round a tongue of a ski shoe, and the sleeve-like element serves for functional arrangement of the buffer body on the inner side of the tongue of the ski shoe, the tibia contact surface being arrangeable on the inner side for substantially providing congruence with a tibia for the purpose of making contact with a surface of the leg formed by the tibia of the lower leg.

18. The ski shoe tongue assembly as claimed in claim 1, wherein the tibia contact surface is adapted to follow the surface of the tibia during use.

* * * * *